US005876205A

United States Patent [19]

Schiabel et al.

[11] Patent Number: 5,876,205

[45] **Date of Patent: *Mar. 2, 1999**

[54] COMBINATION OF MATERIALS FOR INTEGRATED GETTER AND MERCURY-DISPENSING DEVICES AND THE DEVICES SO OBTAINED

[75] Inventors: Antonio Schiabel; Stefano Paolo Giorgi, both of Milan, Italy

[73] Assignee: SAES Getters S.p.A., Lainate, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 626,631

[22] Filed: Mar. 28, 1996

Related U.S. Application Data

[63] Continuation-in-part of Ser. No. 393,543, Feb. 23, 1995, Pat. No. 5,520,560, and Ser. No. 777,785, Jun. 7, 1995.

[30] Foreign Application Priority Data

Apr. 10, 1995 [IT] Italy ..... MI95A0734

[51] Int. Cl.[6] ..... H01J 61/28

[52] U.S. Cl. ..... 445/9; 313/490; 252/181.2; 252/181.3

[58] Field of Search ..... 252/181.3, 181.6, 252/181.2; 445/9, 55; 313/550, 490

[56] References Cited

U.S. PATENT DOCUMENTS

| | | | |
|---|---|---|---|
| 5,022,882 | 6/1991 | White et al. | 445/26 |
| 5,026,311 | 6/1991 | White | 445/26 |
| 5,229,687 | 7/1993 | Fowler et al. | 445/61 X |
| 5,520,560 | 5/1996 | Schiabel et al. | 445/9 |

FOREIGN PATENT DOCUMENTS 52-6071 1/1977 Japan .

*Primary Examiner*—Kenneth J. Ramsey
*Attorney, Agent, or Firm*—Hickman & Martine, LLP

[57] ABSTRACT

A mercury-dispensing device is disclosed that includes a mercury dispenser comprising an intermetallic compound including mercury and a second metal selected from the group consisting of titanium, zirconium, and mixtures thereof; and a promoter that comprises copper, tin and at least a third metal selected among the rare earth elements. A getter material selected among titanium, zirconium, tantalum, niobium, vanadium and mixtures thereof, and alloys of these metals with nickel, iron or aluminum can be included in the device. The mercury dispenser, promoter and optional getter material are provided preferably in the form of powders compressed as a pellet, or contained in a ring-shaped metallic support or rolled on the surfaces of a metallic strip. Also disclosed is a process for introducing mercury into electron tubes by making use of the above-mentioned mercury-dispensing devices.

42 Claims, 3 Drawing Sheets

Fig. 1
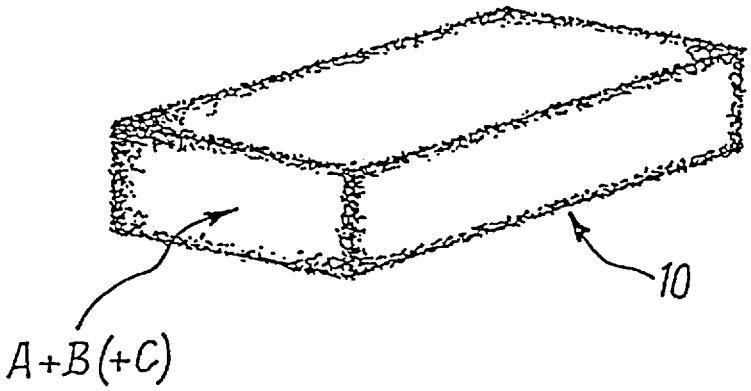
Fig. 2
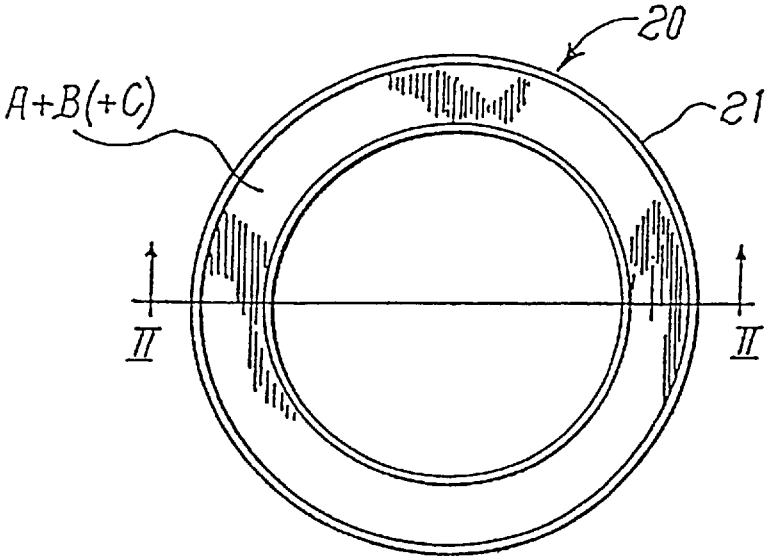
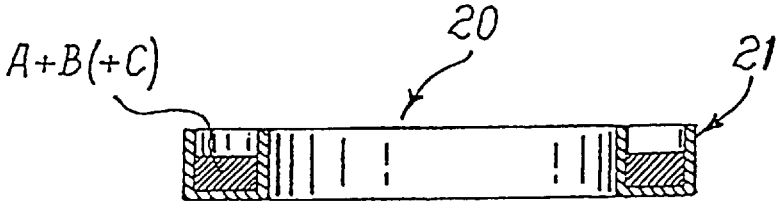
Fig. 2a

COMBINATION OF MATERIALS FOR INTEGRATED GETTER AND MERCURY-DISPENSING DEVICES AND THE DEVICES SO OBTAINED

CROSS REFERENCE TO RELATED APPLICATIONS

This application is a continuation-in-part of U.S. patent application Ser. Nos. 08/393,543, filed Feb. 23, 1995, now U.S. Pat. No. 5,520,560, and 08/777,785, filed Jun. 7, 1995, both of which are incorporated herein by reference for all purposes.

CLAIM TO FOREIGN PRIORITY UNDER 35 U.S.C. § 119

This patent application claims priority under 35 U.S.C. § 119 from Italian Patent Application Serial No. MI 95/A 000734, filed Apr. 10, 1995, which is incorporated herein by reference for all purposes.

BACKGROUND OF THE INVENTION

1. The Field of the Invention

The present invention relates to the deposition of mercury (Hg) within structures and to devices for effecting such deposition. More particularly, the present invention includes mercury-dispensing devices for the introduction of mercury into electron tubes, including mercury-arc rectifiers, lasers, alphanumeric displays and, particularly, fluorescent lamps.

2. The Relevant Art

The use of small amounts of mercury in devices such as, for example, electron tubes, e.g., mercury-arc rectifiers, lasers, various kinds of alphanumeric displays and, particularly, fluorescent lamps, is well known. Providing the minimum quantity of mercury required inside these devices is extremely important to maintain the performance of these devices, and, especially, to minimize environmental impact during their construction and use. The high toxicity of mercury also poses serious ecological hazards relating to the disposal of mercury-containing devices. Such concerns have been the subject of legislative focus, and recent international regulations have sought to establish upper limits for the amount of mercury that can be used in these devices. For example, it has been suggested that fluorescent lamps include no more than 10 milligrams (mg) of mercury per lamp (about 0.7 microliters ($\mu$l)).

Mercury has been introduced into electron tubes in liquid form. However, the high vapor pressure of mercury at room temperature poses problems for its storage and handling. Also, introducing precise and reproducible doses of microliter quantities of liquid mercury is extremely difficult to control, and often results in the introduction of excess amounts of the element into the device.

The use of liquid mercury contained in capsules has been disclosed, for example, in U.S. Pat. Nos. 4,823,047 and 4,754,193, referring to the use of metallic capsules, and in U.S. Pat. Nos. 4,182,971 and 4,278,908 wherein the mercury container is made of glass. Each of these references in incorporated herein by reference for all purposes. After introducing the mercury-containing container into the electron tube, the mercury is released by means of a heat treatment which causes the container tip to break.

These methods generally have several drawbacks. First, the production of the capsules and their mounting inside the electron tubes is complex, especially where the tubes are small. Second, breaking a capsule, especially a glass capsule, can produce fragments of material that can impair the functioning of the electron tube. To address the latter problem, U.S. Pat. No. 4,335,326, incorporated herein by reference for all purposes, discloses an assembly wherein the mercury-containing capsule is itself located inside a capsule which acts as a shield for the fragments. Third, the release of the mercury is often violent and may damage the inner structure of the tube. Finally, capsule systems still use liquid mercury, and therefore do not completely solve the problems of delivering precise and reproducible amounts of a few milligrams of mercury into a small space.

U.S. Pat. No. 4,808,136 and European Patent Application Serial No. EP-568,317, both incorporated herein by reference for all purposes, disclose the use of tablets or small spheres of porous material soaked with mercury which is released by heating once the tube is closed. However, these methods also require complicated operations to load the mercury into the tablets, and the amount of mercury released into the tube is difficult to control reproducibly. In addition, these methods still involve liquid mercury.

The use of amalgams of mercury with, for example, indium, bismuth, or zinc, is also known. In general, however, these amalgams have the drawback of a low melting point coupled with high mercury vapor pressure at relatively low temperatures. For example, the zinc amalgams described in the commercial bulletins of APL Engineering Materials Inc., have a mercury vapor pressure at 43° C. which is about 90% of that of liquid mercury. Consequently, the amalgams do not easily withstand the thermal treatments employed in the production of the electron tubes into which the amalgams are introduced, during which treatments the mercury-dispensing devices may reach temperatures of about 400° C.

These drawbacks are addressed in U.S. Pat. No. 3,657,589, incorporated herein by reference for all purposes, which discloses the use of intermetallic compounds of titanium (Ti), zirconium (Zr) and mercury having the general formula $Ti_xZr_yHg_z$, in which x and y may vary between 0 and 13, the sum x+y may vary between 3 and 13, and z may be 1 or 2. These compounds have mercury-release temperatures which vary according to the specific composition of the intermetallic compound. However, all of these compounds are stable up to about 500° C., both in the atmosphere and in vacuo, making them compatible with the assembly operations for electron tubes. The mercury is released from the above-cited compounds by an activation operation, which is usually carried out by heating the material between 750° C. and 900° C. for about 30 seconds. This heating may be accomplished by laser radiation, or by induction heating of the metallic support of the mercury-dispensing compound. The use of the $Ti_3Hg$ compound (x=3, y=0 and z=1), manufactured and sold by SAES Getters S.p.A. (Milan, Italy) under the trade name "ST 505", has been shown to be particularly advantageous because of its availability in the form of a powder compressed in a ring-shaped container or in pills or tablets, sold under the trademark "STAHGSORB", or in the form of powders laminated on a metallic strip, sold under the trademark "GEMEDIS".

In addition to the above-described stability during the production cycle of the tubes, during which temperatures of about 350°–400° C. may be reached, the $Ti_xZr_yHg_z$ compounds can also be combined with a getter material that can be easily added to the mercury-dispensing compound for the purpose of chemisorption of gases such as carbon monoxide (CO), carbon dioxide ($CO_2$), molecular oxygen ($O_2$), molecular hydrogen ($H_2$), and water ($H_2O$), each of which gases interfere with the tube operation. The getter is activated during the same heat treatment in which the mercury is released as described in U.S. Pat. No. 3,657,589. Furthermore, the amount of mercury released by the $Ti_xZr_y$-$Hg_z$ compounds is controllable and reproducible.

Despite their good chemical and physical characteristics, and their ease of use, these materials have the drawback that the contained mercury is not completely released during the activation treatment. Furthermore, production processes for mercury-containing electron tubes include a tube-closing operation performed by either glass fusion, e.g., for the sealing of fluorescent lamps, or by frit sealing, e.g., welding two pre-shaped glass members by means of a paste of low-melting glass, during which operations the mercury-dispensing device may undergo an indirect heating of up to about 350°–400° C. In this step, the dispensing device is exposed to gases and vapors emitted by the melted glass and, in almost all industrial processes, to air. Under these conditions, the mercury-dispensing material undergoes a surface oxidation, which results in a yield (i.e., the percentage of mercury which is released) of about 40% of the total mercury content during the activation process. The mercury not released during the activation operation is then slowly released during the life of the electron tube. This characteristic, together with the fact that the tube must obviously work from the beginning of its life cycle, leads to the necessity of introducing into the device about twice as much mercury as would be theoretically necessary.

In order to overcome these problems, European Patent Application Serial No. EP-A-091,297, incorporated herein by reference for all purposes, suggests the addition of nickel (Ni) or copper (Cu) powders to the $Ti_xZr_yHg_z$ compounds in which x=3, y=0 and z=1 ($Ti_3Hg$) or x=0, y=3 and z=1 ($Zr_3Hg$). According to this document, the addition of Ni or Cu to the mercury-dispensing compounds causes melting of the mercury-containing materials, favoring the release of almost all of the mercury in a few seconds. The melting takes place at the eutectic temperatures of the Ni—Ti, Ni—Zr, Cu—Ti and Cu—Zr systems, ranging from about 880° C. for the Cu 66%-Ti 34% composition to about 1,280° C. for the Ni 81%-Ti 19% composition (atom percent). However, the document erroneously gives a melting temperature of 770° C. for the Ni 4%-Ti 96% composition.

Despite the advantages disclosed in EP-A-091,297, this document acknowledges that the mercury-containing compounds disclosed therein undergo chemical changes during the tube working treatments, and thus need protection from their environment. To this end it is suggested to enclose the mercury-containing material in containers made of a steel, copper, or nickel sheet which are broken during the activation process by the pressure of the mercury vapor generated inside the container. This solution is not completely satisfactory, however. As described above with respect to the capsule mercury dispensers, the mercury bursts out of the containers violently, possibly damaging portions of the electron tube. Also, manufacturing such containers is quite complicated, requiring the welding of small metallic parts.

Thus, it would be advantageous to provide a mercury dispenser that is capable of delivering small amounts of mercury into devices such as electron tubes reliably, controllably, reproducibly and with little or no damage to other components in the device.

SUMMARY OF THE INVENTION

The present invention provides compositions, methods, and devices that greatly facilitate the deposition of controlled amounts mercury into enclosures that avoid the difficulties in reproducibility and excessive mercury quantities associated with current mercury deposition technologies. Using the compositions, methods, and devices described herein, reproducible, controlled amounts of mercury can be deposited in closed structures, especially electron tubes, more efficient that possible using current methodologies.

In one aspect, the present invention provides a mercury-dispensing composition that comprises an intermetallic compound and a promoting alloy. The intermetallic compound comprises mercury and a second metal that is selected from the group consisting of titanium, zirconium, and mixtures of titanium and zirconium (i.e., compounds of the general formula $Ti_xZr_yHg_z$, where z is non-zero). The promoting alloy includes copper, tin, and at least one rare earth metal. In one embodiment, the intermetallic compound contains titanium or zirconium (i.e., compounds for which x is non-zero and y is zero, or x is zero and y is non-zero). Particular embodiments include those for which the intermetallic compound is $Ti_3Hg$ or $Zr_3Hg$.

In another embodiment, the promoting alloy is selected from among those alloy compositions that, when plotted on a ternary composition diagram as weight percentages, fall within the polygon defined by the points:

a) Cu 63%-Sn 36.5%-MM 0.5%;

b) Cu 63%-Sn 10%-MM 27%;

c) Cu 30%-Sn 10%-MM 60%;

d) Cu 3%-Sn 37%-MM 60%; and e) Cu 3%-Sn 96.5%-MM 0.5%;

where "MM" refers to "misch metal". Particular embodiments include those wherein the promoting alloy has the weight percentage composition Cu 40%-Sn 30%-MM 30%, or Cu 60%-Sn 30%-MM 10%. The intermetallic compound and the promoting alloy are combined, in one embodiment, at a weight ratio of between about 20:1 and about 1:20 inclusive.

In another aspect, the present invention provides mercury-dispensing devices comprising the above-described mercury-dispensing composition. In one embodiment, the device comprises the combination of the above-described intermetallic composition and promoting alloy in the form of powders. In another embodiment, the intermetallic composition and promoting alloy in the form of tables of compressed powders. The intermetallic composition and promoting alloy can be arranged on a support, which, in one embodiment, is the surface of a strip of support material (e.g., metal), or in another embodiment, is the channel of a substantially toroidal grove. However, the intermetallic composition and promoting alloy do not require a support structure.

It has been found that upon treatment effective to cause release of the mercury contained in the mercury-dispensing composition, the remaining material exhibits gettering capability. In still another embodiment, a separate getter material is included with the mercury-dispensing material. In one embodiment, the getter material is selected from the group consisting of titanium, zirconium, tantalum, niobium, vanadium and mixtures thereof, or alloys of titanium, zirconium, tantalum, niobium, vanadium and their mixtures with nickel, iron, or aluminum. More particular getter materials include the getter material having the weight composition Zr 84%-Al 16%, $Zr_2Fe$, and $Zr_2Ni$. The getter material can be combined with the mercury-dispensing composition in the same forms as the components of the mercury-dispensing composition.

In still another aspect, the present invention provides a method of introducing mercury into electron tubes, and the electron tubes so produced. In one embodiment, the method of the invention comprises introducing a mercury-dispensing device into an electron tube, sealing the tube, and heating the device at a temperature effective to release substantially all of the mercury contained in the device into the interior of the electron tube. In one embodiment, the temperature is between about 600° C. and about 900° C. inclusive and said heating is performed for a period between about 10 seconds and about one minute inclusive.

These and other aspects and advantages of the present invention will become more apparent when the Description below is read in conjunction with the accompanying Drawings.

BRIEF DESCRIPTION OF THE DRAWINGS

FIG. 1 is a perspective view of a mercury-dispensing device according to one embodiment of the present invention.

FIGS. 2A and 2B are, respectively, a top plan view and a sectional view taken along line 2—2 of one embodiment of the present invention.

DESCRIPTION OF SPECIFIC EMBODIMENTS

In one aspect, the present invention provides a mercury-dispensing composition which provides a substantially reproducible, controlled release of mercury without the complications and drawbacks of the systems described above. In one embodiment, the mercury-dispensing composition of the invention comprises:

a) an intermetallic compound including mercury and a second metal selected from the group consisting of titanium, zirconium, and mixtures thereof; and b) a promoting alloy including copper, tin, and at least one rare earth metal.

Thus, the intermetallic compound included in the mercury-dispensing composition of the present invention is of the general formula $Ti_xZr_yHg_z$, with $z \neq 0$, as described in the above-incorporated U.S. Pat. No. 3,657,589 and co-pending U.S. patent applications. The intermetallic compound of the composition of the present invention in one embodiment includes titanium or zirconium (i.e., x=0 or y=0). In a more specific embodiment, the mole ratio of titanium or zirconium to mercury is between about 2:1 and about 4:1 inclusive. Two specific embodiments of the composition of the present invention include those for which the intermetallic compound is $Ti_3Hg$ and $Zr_3Hg$. The intermetallic component of the composition can be formed using materials and methods known to those of skill in the metallurgical arts. One example of forming the intermetallic component of the composition is provided in Example 1 below.

The promoting alloy component of the composition of the present invention functions in part to facilitate the release of mercury from the intermetallic compound of the mercury-dispensing composition. This component is a metallic alloy or an intermetallic compound including copper, tin, and one or more rare earth metals. In one embodiment, a mixture of rare earths is employed. It has been found that a mixture of rare earth metals does not affect significantly the performance of the composition of the present invention as compared to a pure rare earth metal, and avoids the difficulties and expense of separating single rare earths from rare earth mixtures. Mixtures of rare earths are known to those having skill in the metallurgical arts by the name "misch metal", also referred to herein as "MM". The promoting alloy component of the composition can be formed using materials and methods known to those of skill in the metallurgical arts, such as illustrated in Examples 2 and 3 below.

Figure 4:
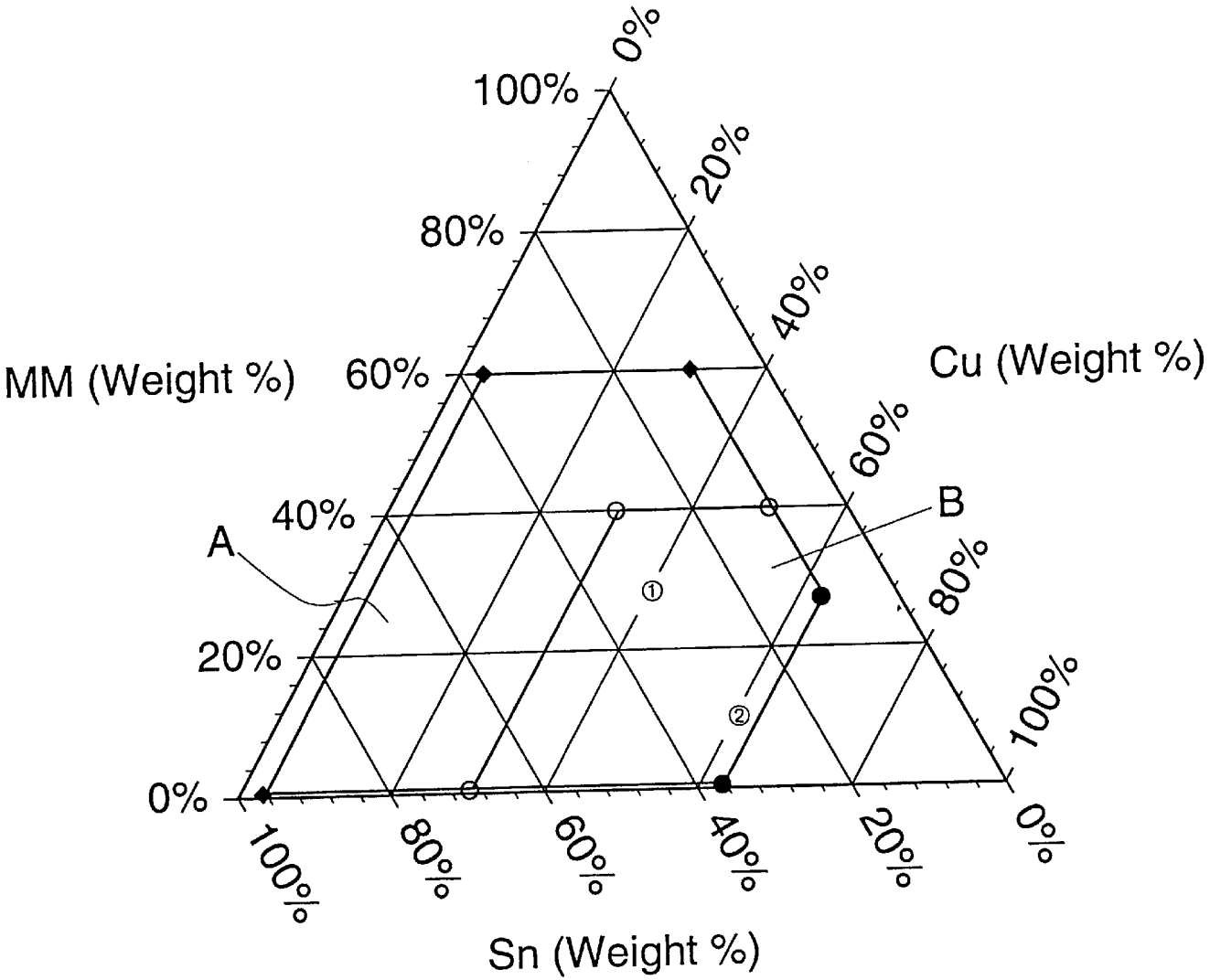
FIG. 4 is a ternary diagram illustrating the weight compositions of the alloys of the present invention.

The weight ratio between copper, tin, and MM can vary within a wide range, but advantageous results have been obtained with promoting alloy compositions selected from the group consisting of alloy compositions that, when plotted on a ternary diagram as weight percentages, fall within the polygon defined by the points labelled by diamonds (♦) denoted "A" in FIG. 4:

a) Cu 63%-Sn 36.5%-MM 0.5%;

b) Cu 63%-Sn 10%-MM 27%;

c) Cu 30%-Sn 10%-MM 60%;

d) Cu 3%-Sn 37%-MM 60%; and e) Cu 3%-Sn 96.5%-MM 0.5%.

More specific embodiments include those for which the promoting alloy is selected from the group consisting of alloy compositions that, when plotted on a ternary diagram as weight percentages, fall within the polygon defined by the points labelled by open circles (○) denoted "B" in FIG. 4:

a) Cu 63%-Sn 36.5%-MM 0.5%;

b) Cu 63%-Sn 10%-MM 27%;

c) Cu 50%-Sn 10%-MM 40%;

d) Cu 30%-Sn 30%-MM 40%; and e) Cu 30%-Sn 69.5%-MM 0.5%.

These polygons are illustrated in the ternary diagram shown in FIG. 4. Two useful promoting alloy compositions are Cu 40%-Sn 30%-MM 30% by weight, and Cu 60%-Sn 30%-MM 10% by weight, which are denoted by points ① and ② respectively. Comparative tests describing these latter compounds are described in Examples 4–9 below.

In general, it has been found that promoting alloys having a copper percentage greater than about 63% exhibit a high melting point, and, consequently, require excessive heating for activation; while copper percentages lower than about 3% demonstrate an unsuitably low melting point. Too low a melting point brings the risk of having a low-viscosity liquid phase at the glass sealing temperatures, which vary from about 600° C. to about 800° C. during the production of the lamps. If the misch metal ("MM") concentration is greater than about 60% by weight, the alloy can become excessively reactive, and potentially could give rise to violent reactions both during the lamp production and activation steps. Finally, if the tin content is lower than about 10% by weight, the alloy can also have too great a melting point.

In one embodiment, the weight ratio of the intermetallic compound to the promoting alloy in the mercury-dispensing composition of the invention is between about 20:1 and about 1:20 inclusive. More specifically, the weight ratio of the intermetallic compound to the promoting alloy is between about 10:1 and about 1:5 inclusive.

The intermetallic compound and promoting alloy components of the mercury-dispensing composition of the invention may be employed in various physical forms; not necessarily the same for the two components using materials and techniques known in the metallurgical arts. For example, the promoting alloy may be present in the form of a coating on a metallic support, and the intermetallic compound as a powder adhered to the promoting alloy by rolling. In one embodiment, both components are in the form of a fine powder, having a particle size less than about 250 μm. In another, more specific, embodiment, the particle size is between about 10 μm and about 125 μm inclusive. The powders can be compressed to form tablets.

The present invention, in a second aspect thereof, provides mercury dispensing devices comprising the above-described composition including the intermetallic compound and promoting alloy. As previously mentioned, one of the advantages of the combination of materials of the invention with respect to prior art systems is that they do not require mechanical protection from the environment. Consequently, the mercury dispensing devices of the present invention can be manufactured in a wide variety of different geometric shapes, thus allowing the mercury-dispensing devices of the present invention to be placed in a wide variety of enclosures. In addition, the intermetallic compound and promoting alloy can be employed with or without a support.

In those embodiments utilizing a support, the support can be metallic or another material which is suitable for supporting the above-described alloys. In one embodiment, the support is a strip of material. In another embodiment, both the intermetallic compound and promoting alloy are deposited on one surface of the support. In still another embodiment, the intermetallic compound and promoting alloy are deposited on opposing surfaces of the support. In yet another embodiment, the support is a substantially toroidal channel into which the intermetallic compound and promoting alloy are deposited.

In another embodiment, the mercury-dispensing device of the invention also includes a getter material for removing traces of various gases such as CO, $CO_2$, $H_2$, $O_2$ or ($H_2O$). The addition of a getter material is particularly advantageous in fluorescent lamps, as the performance and lifespan of these lamps is degraded by the presence of such gases. An important advantage offered by the combinations of the present invention is that the residue remaining after the evaporation of mercury has a getter activity. The amount of gas which can be absorbed by the residue, and the absorption velocity, have been found to be capable of providing an adequate degree of vacuum for many applications. It will be appreciated by those of skill in the getter arts that the ability of the combinations of the present invention to produce residues having significant getter capacity following the release of mercury, which gettering capacity is described in more detail in Examples 10–14 below, is a surprising and unexpected property of mercury-dispensing materials.

In order to increase the total gas absorption velocity and capacity of this device the present invention includes embodiments in which a separate getter material has been added to the mercury-dispensing device. These separate getter materials can be added to the mercury-dispensing device of the invention using, for example, the techniques described in above-cited U.S. Pat. No. 3,657,589. Examples of getter materials include, among others, metals such as titanium, zirconium, tantalum, niobium, vanadium, and mixtures thereof, and alloys of these materials with other metals such as nickel, iron, and aluminum. In one embodiment, the getter material comprises zirconium, and, more particularly is an aluminum-zirconium alloy having a weight percentage composition of 84% Zr and 16% Al, which is available commercially from SAES Getters S.p.A. (Lainate, Italy) under the tradename "ST 101®". In another embodiment, the getter material is selected from the intermetallic compounds $Zr_2Fe$ and $Zr_2Ni$, also sold commercially by SAES Getters under the tradenames "ST 198" and "ST 199" respectively. The getter material is activated during the same heat treatment by which mercury is released inside the tube. It will be appreciated that, due to the gettering activity of the mercury-dispensing composition of the invention following the release of mercury, the amount of getter material required by the device may be somewhat less as compared to prior art mercury-dispensing devices used in the same application.

The getter material may be present in various physical forms, but it is preferably employed in the form of a fine powder, having a particle size less than about 250 μm and, more specifically, between about 10 μm and about 125 μm inclusive. The ratio between the overall weight of the intermetallic compound and promoting alloy materials and the getter material may generally range from about 10:1 to about 1:10 inclusive, more specifically between about 5:1 and about 1:5 inclusive, and, still more specifically, between about 5:1 and about 1:2 inclusive. As described above, all three materials may employed as powders or tablets, alone or in combination, and may be deposited into or on the surface of a support structure.

Some possible embodiments of the mercury-dispensing devices of the invention are illustrated below with reference to the drawings.

In one embodiment, shown in FIG. 1, the device of the invention comprises a tablet 10 including compressed and unsupported powders of the intermetallic compound and promoting alloy (and possibly getter) materials. In other embodiments, the tablet has a substantially cylindrical or substantially parallelepipedal shape; this latter embodiment is shown in FIG. 1. In the case of supported materials, the device may have the shape of a ring 20 as shown in FIG. 2A, which represents a top plan view of the device. FIG. 2B illustrates a cross-section along 2—2 of ring 20. In this case, the device comprises a support 21 having the shape of a substantially toroidal channel containing the intermetallic compound and promoting alloy (and possibly getter) materials. In one embodiment, the support is metallic, and, in a specific embodiment, nickel-plated steel.

Figure 3:
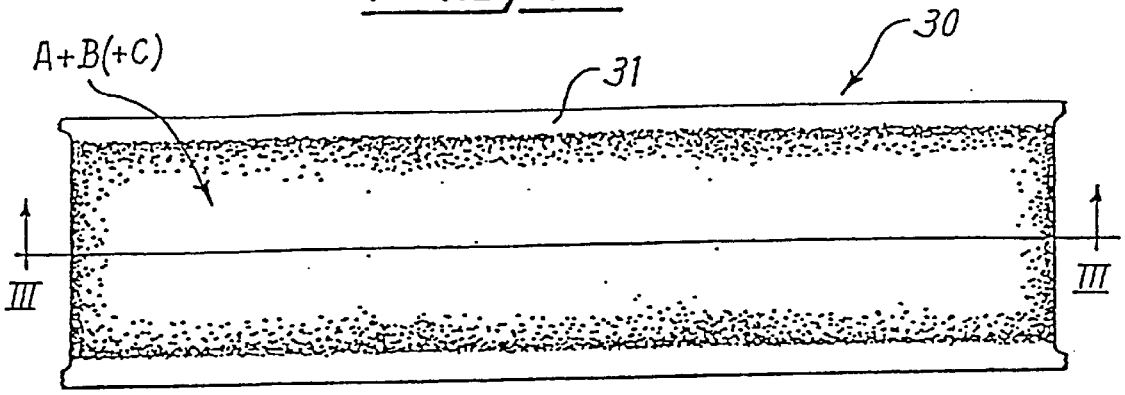
FIGS. 3A, 3B, and 3C are, respectively, a top plan view and two sectional views along line 3—3 of two embodiments of a device according to the present invention.
Figure 3A:
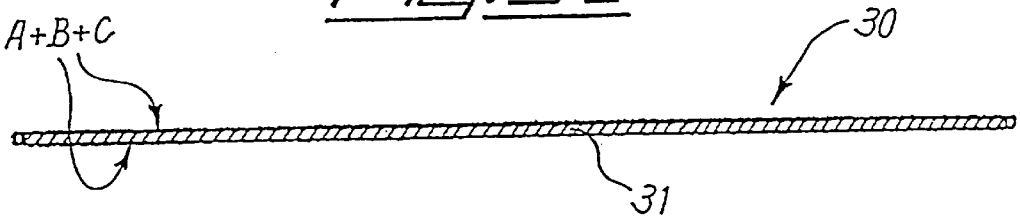
Figure 3B:
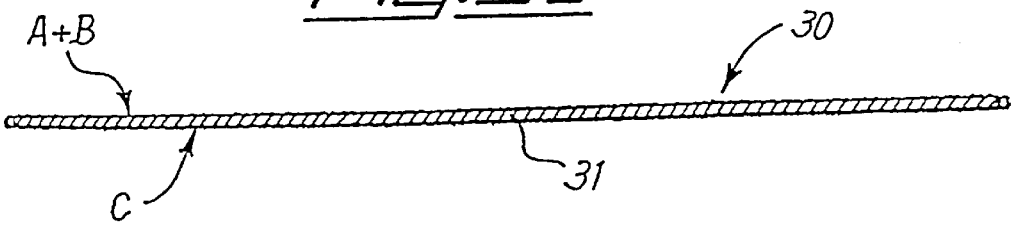

In another embodiment, the mercury-dispensing device of the invention comprises a strip 30 as shown in FIG. 3A, which presents a top plan view of the device, and in FIGS. 3B and 3C which show sections taken along line 3—3 of device 30. In this embodiment, support 31 comprises a strip of support material, which can be nickel-plated steel, onto which support strip the intermetallic compound and promoting alloy (and possibly getter) materials are deposited, e.g., by cold compression (rolling). In one embodiment of the illustrated strip configuration which includes a getter material, all three materials are mixed together and deposited on one or both faces of the strip (see FIG. 3A), or the intermetallic compound and promoting alloy are rolled on one surface of the strip and the getter material is deposited on the opposing side, as shown in FIG. 3B. Other configurations, materials, and methods of deposition will be apparent to those having skill in the getter arts.

The invention, in a further aspect thereof, relates to a method for introducing mercury into electron tubes, e.g., mercury-arc rectifiers, lasers, and fluorescent lamps, by using the above-described devices and the electron tubes so produced. In one embodiment, the method of the invention includes the steps of introducing the above-described mercury-dispensing combination of materials inside the tube (e.g., in one of the above-described devices 10, 20 or 30), sealing the tube, and heating the materials to effect the release of substantially all of the mercury from the intermetallic compound. As used herein, the term "substantially all"

as used with respect to the release of mercury from the intermetallic compound means that at least about 80% of the mercury in the intermetallic compound is released. The heating step may be performed using any suitable means such as, for example, radiation, high-frequency induction heating, or flowing a current through the support when the latter is made of a material having a high electric resistivity. The heating is effected at a temperature effective to induce the release of mercury from the mercury-dispensing combination. In one embodiment, the combination is heated to a temperature between about 600° C. and about 900° C. inclusive for a period between about 10 seconds and about one minute inclusive. At temperatures less than about 600° C. the mercury may not be dispensed completely, whereas at temperatures greater than about 900° C. noxious gases may be evolved by outgassing from portions of the electron tube adjacent the device or by the formation of metal vapors in the tube.

EXAMPLES

The following examples describe specific aspects of the invention to illustrate the invention and aid those of skill in the art in understanding and practicing the invention. However, these examples should not be construed as limiting the invention in any manner.

Examples 1–3 concern the preparation of the mercury dispensing and promoting materials. Examples 4–9 concern the tests for the mercury release after the heat treatment simulating the sealing operation. Examples 10–14 concern tests for gettering activity of the residue remaining after mercury evaporation for some combinations of material of the invention and some comparative combinations. All the metals used for the preparation of alloys and compounds for the following tests have a minimum pureness of 99.5% and are obtained using standard methods and materials. In the compositions of the examples all percentages are on a weight basis unless specified otherwise.

Example 1

This example illustrates the synthesis of the mercury-dispensing material $Ti_3Hg$.

143.7 g of titanium was placed in a steel cradle and degassed by a furnace treatment at a temperature of about 700° C. and a pressure of about 104 millibar (mbar) for about 30 minutes. After cooling the titanium powder in an inert atmosphere, about 200.6 g of mercury was introduced in the cradle by means of a quartz tube. The cradle was closed and heated at about 750° C. for about 3 hours. After cooling, the product was ground until a powder passing through a 120 $\mu$m mesh-size standard sieve was obtained. The resulting material was predominantly $Ti_3Hg$ as confirmed by a standard diffractometric test performed on the powder.

Example 2

This example concerns the preparation of a promoting alloy.

40 g of Cu, 30 g of Sn, and 30 g of MM, in powder form, were placed into an alumina cradle and introduced in a vacuum induction furnace. The misch metal used contained by weight about 50% cerium, about 30% lanthanum, and about 15% neodymium, the remainder being other rare earth metals. The mixture was heated at a temperature of about 900° C., and kept at that temperature for about 5 minutes to encourage homogeneity, before being cast into a steel ingot-mould. Each ingot was ground in a blade mill and the resulting powder was sieved as described in Example 1. The composition of the alloy so obtained was Cu 40%-Sn 30%-MM 30%, shown at ① in FIG. 4.

Example 3

This example concerns the preparation of a promoting alloy.

The procedure of Example 2 was repeated using 60 g of Cu, 30 g of Sn, and 10 g of MM in powder form. The composition of the obtained alloy was Cu 60%-Sn 30%-MM 10%, shown at ② in FIG. 4.

Examples 4–9

Examples 4–9 concern tests for mercury release after a heat treatment in air under conditions that simulated the frit conditions to which the device is subjected during the tube closing operation (hereafter generally referred to as "sealing"). Examples 4–7 are comparative examples which show the release after frit sealing respectively by the dispensing component alone (4) and by the same mixed only with copper, tin and the above-cited getter alloy St101 (5–7); a similar comparative test on a mixture of $Ti_3Hg$ and MM powders was not possible due to the excessive reactivity of this mixture.

For simulation of the sealing, 150 mg of each powder mixture was loaded in a ring-shaped container such as shown in FIG. 2, or on a strip such as shown in FIG. 3A, and was subjected to the following thermal cycle in air:

- heating from room temperature to about 450° C. in about 5 seconds;
- isotherm at about 450° C. for about 60 seconds;
- cooling from about 450° C. to about 350° C., over a period of about 2 seconds;
- isotherm at about 350° C. for about 30 seconds; and
- spontaneous cooling to room temperature, over a period of about 2 minutes.

Thereafter, the mercury release tests were carried out on the treated samples by induction heating at about 850° C. for about 30 seconds inside a vacuum chamber, followed by measurement of the mercury remaining in the dispensing device using the method of the complexometric titration according to Volhard (Wilson and Wilson 1962).

The results of the tests are summarized in Table 1, which shows the mercury-dispensing compound ("A"), the promoting alloy ("B"), (the symbols (① and ② indicating the composition of the Cu—Sn-MM alloy as shown in FIG. 4), the weight ratio between components A and B ("A/B"), and the mercury yield as a percentage of released mercury on the total content of the device (Hg Yield (%)"). The comparative examples are marked by a star.

TABLE 1

| Example | A | B | A/B | Hg Yield (%) |
|---|---|---|---|---|
| 4* | $Ti_3Hg$ | — | — | 35.2 |
| 5* | $Ti_3Hg$ | Cu | 7/3 | 34.0 |
| 6* | $Ti_3Hg$ | Sn | 5/1 | 25.0 |
| 7* | $Ti_3Hg$ | St 101 | 1/1 | 22.4 |
| 8 | $Ti_3Hg$ | Cu—Sn—MM (①) | 2/1 | 80.0 |
| 9 | $Ti_3Hg$ | Cu—Sn—MM (②) | 2/1 | 87.0 |

Examples 10–14

Examples 10–14 describe the results of tests for determining the gettering capacity of the residues remaining after the mercury release by the combinations of the invention and by some comparative combinations as getter materials. These tests were performed by simulating the frit conditions to which the materials are subjected during the bending and sealing operations of compact fluorescent circular lamps, which conditions, as mentioned above, are more stringent that those for straight lamps. In particular, the combinations of the examples have been subjected to the following thermal cycle in air:

heating from room temperature to about 600° C. in about 10 seconds;

isotherm at about 600° C. for about 15 seconds; and spontaneous cooling to room temperature, over a period of about 2 minutes.

The mercury release tests (activation) were carried out after simulation of the frit sealing on the samples. The fritted samples were introduced inside a vacuum chamber having a volume of about 1 liter, and heated under vacuum at a temperature of about 850° C. over a period of about 10 seconds and held at that temperature for about 20 seconds.

The capacity of the residue to work as a getter was measured after the activation and performed by introducing an amount of hydrogen into the chamber so as to bring the chamber pressure to about 0.1 mbar at a temperature of about 30° C., followed by measuring the time required for the pressure in the chamber to decrease to about 0.01 mbar. The pressure was measured using a standard capacitive manometer. The results of these tests are summarized in Table 2, which shows the composition of the sample ("Sample Composition"), and the hydrogen absorption velocity at 30° C. ("$H_2$ Absorption Velocity (cc/s)"). The comparative combinations are marked by a star.

TABLE 2

| Example | Sample Composition | $H_2$ Absorption Velocity (cc/s) |
|---|---|---|
| 10* | $Ti_3Hg$ | Not Measurable |
| 11* | $Ti_3Hg$: 50%<br>ST 101: 50% | 7.2 |
| 12 | $Ti_3Hg$: 60%<br>Cu—Sn—MM (①): 40% | 6.9 |
| 13 | $Ti_3Hg$: 60%<br>Cu—Sn—MM (②): 40% | 3.5 |
| 14 | $Ti_3Hg$: 30%<br>Cu—Sn—MM (①): 20%<br>ST 101: 50% | 15.3 |

As seem in Table 1, mercury-dispensing compositions including the promoter of the invention allow mercury yields of greater than about 80% during the activation step even after frit sealing in air at 450° C.; thus permitting the reduction of the overall mercury amount introduced in the electron tubes. Furthermore, as shown by the data in Table 2, the residue remaining after the mercury release has getter activity. In fact, while the residue remaining after the mercury release by the $Ti_3Hg$ compound alone has no getter activity, the sample of Example 12 to which no getter has been added exhibits a significant hydrogen absorption velocity (i.e., a hydrogen sorption velocity greater than about 6.5 cc/s). Moreover, Example 12 demonstrates a hydrogen absorption velocity comparable to that of the sample of Example 11, which is a combination of a mercury dispenser with a getter that is widely used by lamp manufacturers. When a getter material is added to the combination of Example 12, the hydrogen absorption velocity becomes nearly twice that of Example 11 which has the same percentage of getter material. These properties of the composition of the invention make it possible to use very small amounts of additional getter material, or even none, while retaining the functionality of the devices in which it is used.

The combinations with promoter of the present invention offer another important advantage, consisting in the possibility of performing the activation operation at lower temperatures, or over shorter time periods, than those allowed by prior art materials. Indeed, industrially acceptable activation times for $Ti_3Hg$ alone require an activation temperature of about 900° C. which causes numerous complications and expenses. In contrast, the present invention allows for the reduction of both the operation time and the size of the lines for the production of the lamps; thus achieving a double advantage of creating less pollution inside the tube due to the outgassing of all the materials present therein and of reducing the amount of energy and expense required for the activation compared with present technologies.

Thus, it will be appreciated that the compositions, devices, methods, and products of the present invention provide for the implantation of mercury in electron tubes that is cleaner and more efficient than presently available. These features arise from the unique properties of lower activation temperature, more efficient mercury release, and residual gettering capability provided by the present invention.

Although certain embodiments and examples have been used to describe the present invention, it will be apparent to those having skill in the art that various changes can be made to those embodiment and/or examples without departing from the scope or spirit of the present invention. The following materials are incorporated herein by reference in their entirety for all purposes.

Wilson, C. L., and Wilson, D. W. 1962. *Comprehensive Analytical Chemistry*. Elsevier.

What is claimed:

1. A mercury-dispensing composition, comprising:

a) an intermetallic compound including mercury and a second metal selected from the group consisting of titanium, zirconium, and mixtures thereof; and b) a promoting alloy including copper, tin, and at least one rare earth metal.

2. The mercury-dispensing composition of claim 1, wherein said intermetallic compound includes titanium or zirconium.

3. The mercury-dispensing composition of claim 2, wherein the mole ratio of titanium or zirconium to mercury is between about 2:1 and about 4:1, inclusive.

4. The mercury-dispensing composition of claim 3, wherein said intermetallic compound is $Ti_3Hg$ or $Zr_3Hg$.

5. The mercury-dispensing composition of claim 1, wherein said promoting alloy is selected from the group consisting of alloy compositions that, when plotted on a ternary diagram as weight percentages, fall within the polygon defined by the points:

a) Cu 63%-Sn 36.5%-MM 0.5%;

b) Cu 63%-Sn 10%-MM 27%;

c) Cu 30%-Sn 10%-MM 60%;

d) Cu 3%-Sn 37%-MM 60%; and e) Cu 3%-Sn 96.5%-MM 0.5%.

6. The mercury-dispensing composition of claim 5, wherein said promoting alloy is selected from the group consisting of alloy compositions that, when plotted on a ternary diagram as weight percentages, fall within the polygon defined by the points:

a) Cu 63%-Sn 36.5%-MM 0.5%;

b) Cu 63%-Sn 10%-MM 27%;

c) Cu 50%-Sn 10%-MM 40%;

d) Cu 30%-Sn 30%-MM 40%; and e) Cu 30%-Sn 69.5%-MM 0.5%.

7. The mercury-dispensing composition of claim 6, wherein said promoting alloy has the composition Cu 40%-Sn 30%-MM 30% by weight.

8. The mercury-dispensing composition of claim 6, wherein said promoting alloy has the composition Cu 60%-Sn 30%-MM 10% by weight.

9. The mercury-dispensing composition of claim 1, wherein the weight ratio of the intermetallic compound to the promoting alloy is between about 20:1 to about 1:20 inclusive.

10. The mercury-dispensing composition of claim 9, wherein the weight ratio of the intermetallic compound to the promoting alloy is between about 10:1 to about 1:5 inclusive.

11. A mercury-dispensing device comprising the composition of claim 1.

12. The mercury-dispensing device of claim 11, wherein said intermetallic compound and said promoting alloy each are in the form of a powder.

13. The mercury-dispensing device of claim 12, consisting of a tablet of compressed powders of said intermetallic compound and said promoting alloy.

14. The mercury-dispensing device of claim 12, wherein said intermetallic compound and said promoting alloy are deposited in a metallic support having the shape of a toroidal channel.

15. The mercury-dispensing device of claim 12, wherein the combination of said intermetallic compound and said promoting alloy are deposited onto the surface of a support.

16. The mercury-dispensing device of claim 15, wherein said support comprises a strip of support material.

17. The mercury-dispensing device of claim 11, further comprising a getter material.

18. The mercury-dispensing device of claim 17, wherein said getter material is selected from the group consisting of: titanium, zirconium, tantalum, niobium, vanadium and mixtures thereof, or alloys of titanium, zirconium, tantalum, niobium, vanadium and their mixtures with nickel, iron, or aluminum.

19. The mercury-dispensing device of claim 18, wherein said getter material comprises Zr.

20. The mercury-dispensing device of claim 19, wherein said getter material is an alloy having the composition Zr 84%-Al 16% by weight.

21. The mercury-dispensing device of claim 19, wherein said getter material is $Zr_2Fe$.

22. The mercury-dispensing device of claim 19, wherein said getter material is $Zr_2Ni$.

23. The mercury-dispensing device of claim 19, wherein said intermetallic compound, said promoting alloy, and said getter material are disposed on a surface of a support.

24. The mercury-dispensing device of claim 19, wherein the ratio between the total weight of said intermetallic compound and said promoting alloy to the weight of said getter material is between about 10:1 and about 1:10 inclusive.

25. The mercury-dispensing device of claim 24, wherein said ratio is between about 5:1 and about 1:5.

26. The mercury-dispensing device of claim 25, wherein said ratio is between about 5:1 and about 1:2.

27. The mercury-dispensing device of claim 19, wherein the mercury-dispensing material, the promoter and the getter are in the form of powders having a particle size less than about 250 $\mu$m.

28. The mercury-dispensing device of claim 27, wherein the mercury-dispensing material, the promoter and the getter are in the form of powders having a particle size between about 10 $\mu$m and about 125 $\mu$m inclusive.

29. The mercury-dispensing device of claim 17, wherein each of said intermetallic compound, said promoting alloy, and said getter material are in the form of a powder.

30. The mercury-dispensing device of claim 17, comprising a tablet of compressed powders of each of said intermetallic compound, said promoting alloy, and said getter material.

31. The mercury-dispensing device of claim 17, wherein said intermetallic compound, said promoting alloy are disposed on a surface of a support, and said getter material is disposed on the opposing surface of said support.

32. The mercury-dispensing device of claim 31, wherein said support is a metallic strip.

33. The mercury-dispensing device of claim 31, wherein said support is a substantially toroidal channel.

34. A process for introducing mercury inside electron tubes, comprising the steps of:

a) introducing into said electron tube the device of claim 11;

b) sealing said electron tube; and c) heating said device at a temperature effective to release substantially all of the mercury contained in said device into the interior of said electron tube.

35. The process of claim 34, wherein said temperature is between about 600° C. and about 900° C. inclusive and said heating is performed for a period between about 10 seconds and about one minute inclusive to effect thereby release of substantially all of the mercury contained in said device into the interior of said electron tube.

36. The process of claim 34, wherein said electron tube is a fluorescent lamp.

37. The process of claim 34, wherein said electron tube is a compact circular fluorescent lamp.

38. An electron tube comprising the device of claim 11.

39. A mercury-dispensing composition, comprising:

a) an intermetallic compound including mercury and a second metal selected from the group consisting of titanium, zirconium, and mixtures thereof; and b) a promoting alloy including copper, tin, and at least one rare earth metal;

wherein upon activation substantially all of said mercury is released from said intermetallic compound to produce a residue having a significant hydrogen absorption velocity.

40. The mercury-dispensing composition of claim 39, wherein at least about 80% of said mercury is released upon activation.

41. The mercury-dispensing composition of claim 40, wherein at least about 85% of said mercury is released upon activation.

42. The mercury-dispensing composition of claim 40, wherein said hydrogen velocity is greater than about 6.5 cc/s.

* * * * *